US006048055A

United States Patent [19]

Hakkaku

[11] Patent Number: 6,048,055

[45] Date of Patent: Apr. 11, 2000

[54] INK TANK SYSTEM FOR INK JET PRINTER

[75] Inventor: Kunio Hakkaku, Tokyo, Japan

[73] Assignee: Fuji Photo Film Co., Ltd., Kanagawa, Japan

[21] Appl. No.: 09/146,245

[22] Filed: Sep. 3, 1998

[30] Foreign Application Priority Data

Sep. 3, 1997 [JP] Japan ..... 9-252666

[51] Int. Cl.[7] ..... B41J 2/175

[52] U.S. Cl. ..... 347/86; 347/85

[58] Field of Search ..... 347/84, 85, 86, 347/87; 141/110

[56] References Cited

U.S. PATENT DOCUMENTS 4,558,326 12/1985 Kimura et al. ..... 347/30
5,479,968 1/1996 Sanchez et al. ..... 347/85
5,485,187 1/1996 Okamura et al. ..... 347/85
5,917,526 6/1999 Wilson et al. ..... 347/86
5,949,459 9/1999 Gasvoda et al. ..... 347/86

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

There is provided an ink tank system for supplying ink to a print head of an ink jet printer from a replaceable ink tank by pressurizing inside of the ink tank with pressurized air. By disposing an air filter in an air supply channel of the ink tank, dust is prevented from entering the ink tank together with air, and the ink is prevented from adhering to the air filter, thereby keeping smooth ink force-feeding. At the time the ink tank is mounted, a seal releasing pin protruded on the side of a printer unit opens an auxiliary seal for sealing between the air filter in the air supply channel and an air chamber of the ink tank. After the ink tank is mounted, the pressurized air is passed through the air filter and fed into the ink tank. A replaceable ink tank used in the system is also provided.

8 Claims, 4 Drawing Sheets

INK TANK SYSTEM FOR INK JET PRINTER

BACKGROUND OF THE INVENTION

1. Field of the Invention

The present invention relates to an ink tank system using a replaceable ink tank for supplying ink to a print head of an ink jet printer for ejecting ink drops to printing sheets. The present invention also relates to a replaceable ink tank used in the ink tank system.

2. Description of the Related Art

A piezo-ink jet system is known in which a small amount of ink is momentarily pressurized using a piezoelectric element to eject ink droplets to the printing sheet. A bubble ink jet system is also known in which a small amount of ink is momentarily heated to generate bubbles and ink drops are ejected toward printing sheets by the action of the pressure of expanding bubbles.

In the printing mode of jetting ink drops, liquid ink is stored in a tank (ink tank), and ink is supplied to a printer head from the tank. Here, for example, when a large-sized poster is print-outputted or in another case of a large printing sheet, ink consumption is large. Accordingly, it is proposed that the ink tank be designed to be replaceable.

For example, a system is proposed in which an air pump is provided on the side of a printer body and pressurized air is fed into an ink tank from the air pump to force-feed ink to a printer head. In this system, a connector needs to be disposed between the printer main body and the ink tank, by which an air supply channel for feeding the pressurized air to the ink tank and an ink supply channel for supplying ink from the ink tank to the print head of the printer unit can be disconnected.

In the ink-jet printing system, since an ink drop jetting port of the print head is remarkably small, a slight dust contaminated in ink may clog the jetting port of the nozzle, thereby causing failure. Although the ink tank containing a quantity of ink is delivered to a user in a sealed condition, dust may enter the tank together with air especially from a pressurized air supply system when the user exchanges the ink tank for a new one.

To solve the problem, it is assumed that an air filter is provided in an air supply channel of the tank so that air surely passes through the air filter before entering the tank. In this case, however, while the ink tank is transported, the ink in the tank adheres to the air filter and solidifies. Therefore, there raises a problem that resistance increases when air passes through the air filter and the ink cannot be smoothly force-fed to the printer body.

SUMMARY OF THE INVENTION

The present invention has been accomplished in consideration of the circumstances above, and an object thereof is to provide a printer ink tank system in which an air filter is disposed in an air supply channel of an ink tank to prevent dust from entering the ink tank together with air and in which ink is prevented from adhering to the air filter to keep the smooth force-feeding of ink to a print head of the printer.

To attain this and other objects, the present invention provides an ink tank system for supplying ink to a print head of an ink jet printer from a replaceable ink tank by pressurizing inside of the ink tank with pressurized air, comprising:

an air supply channel disposed with the ink tank for feeding the pressurized air supplied from a printer unit into the ink tank, the air supply channel having an auxiliary seal for closing the channel and, at an upstream side of the auxiliary seal, being branched to a main air supply channel and an auxiliary channel, an air filter being disposed in the main air supply channel;

an ink supply channel disposed with the ink tank;

an air inlet disposed on an upstream terminal end of said main air supply channel and having a first main seal for hermetically sealing the air inlet;

an ink outlet disposed on a downstream terminal end of said ink supply channel of the ink tank and having a second main seal for hermetically sealing the ink outlet;

a seal release port disposed on a terminal end of said auxiliary channel;

a first hollow needle disposed on the side of the printer unit and being engageable with said air inlet to advance into the air inlet to hermetically penetrate the first main seal, said first hollow needle supplying the pressurized air into the ink tank via said air supply channel;

a second hollow needle disposed on the side of the printer unit and being engageable with said ink outlet to advance into the ink outlet to hermetically penetrate the second main seal, said second hollow needle receiving the ink stored the ink tank to feed the ink to the print head; and a seal releasing protrusion disposed on the side of printer unit and advancing into said seal release port to break sealing of said auxiliary seal, said first hollow needle, said second hollow needle and said seal releasing protrusion being extended parallel with one another.

When the ink tank is mounted on the printer unit, the first and second hollow needles are hermetically passed through the first and second main seals, respectively, and the seal releasing protrusion is advanced into said seal release port to open said auxiliary seal. Accordingly, the pressurized air supplied via the first hollow needle is passed through the air filter in the main air supply channel and the opened auxiliary seal in the air supply channel and fed into the ink tank, and the ink in the pressurized ink tank is force-fed toward the print head via the second hollow needle.

Here, the auxiliary seal can be constituted of a film which is broken by a pin pushed and moved by the seal releasing protrusion to open the air supply channel at the time the tank is mounted. Moreover, on the side of the ink tank, an air inlet port and an ink outlet port are arranged parallel on opposite sides of the seal release port. It is preferable that the seal release port be protruded ahead of the air inlet port and the ink outlet port in a direction in which the tank is mounted, so that the air inlet port and ink outlet port can be protected from obstacles while the tank is transported.

When the ink tank is unused, the auxiliary seal is interposed between the inside of the ink tank and the air filter in the air supply channel, so that the ink stored in the ink tank is prevented from adhering to the air filter. Therefore, the ink is prevented from making wet or dirty the air filter, to avoid deterioration of the filtering function of the air filter while the ink tank is transported. Possible obstruction to the ink feeding can be eliminated.

When the ink tank is mounted on the printer unit, the first hollow needle (also referred to an air supply pin, hereinafter) and the second hollow needle (also referred to an ink receiving pin, hereinafter) both on the side of the printer engage the air inlet port and the ink outlet port both on the side of the ink tank, respectively, and hit and break the respective main seals in these ports. Simultaneously, the seal releasing protrusion opens the auxiliary seal. Therefore, the pressurized air is supplied from the printer unit through the air supply pin, the air inlet port, the air filter and the air supply channel, and fed into the ink tank. As a result, the ink stored in the ink tank is flown through the ink outlet port and the ink receiving pin, and force-fed to the printer unit.

DETAILED DESCRIPTION OF THE PREFERRED EMBODIMENT

Figure 1:
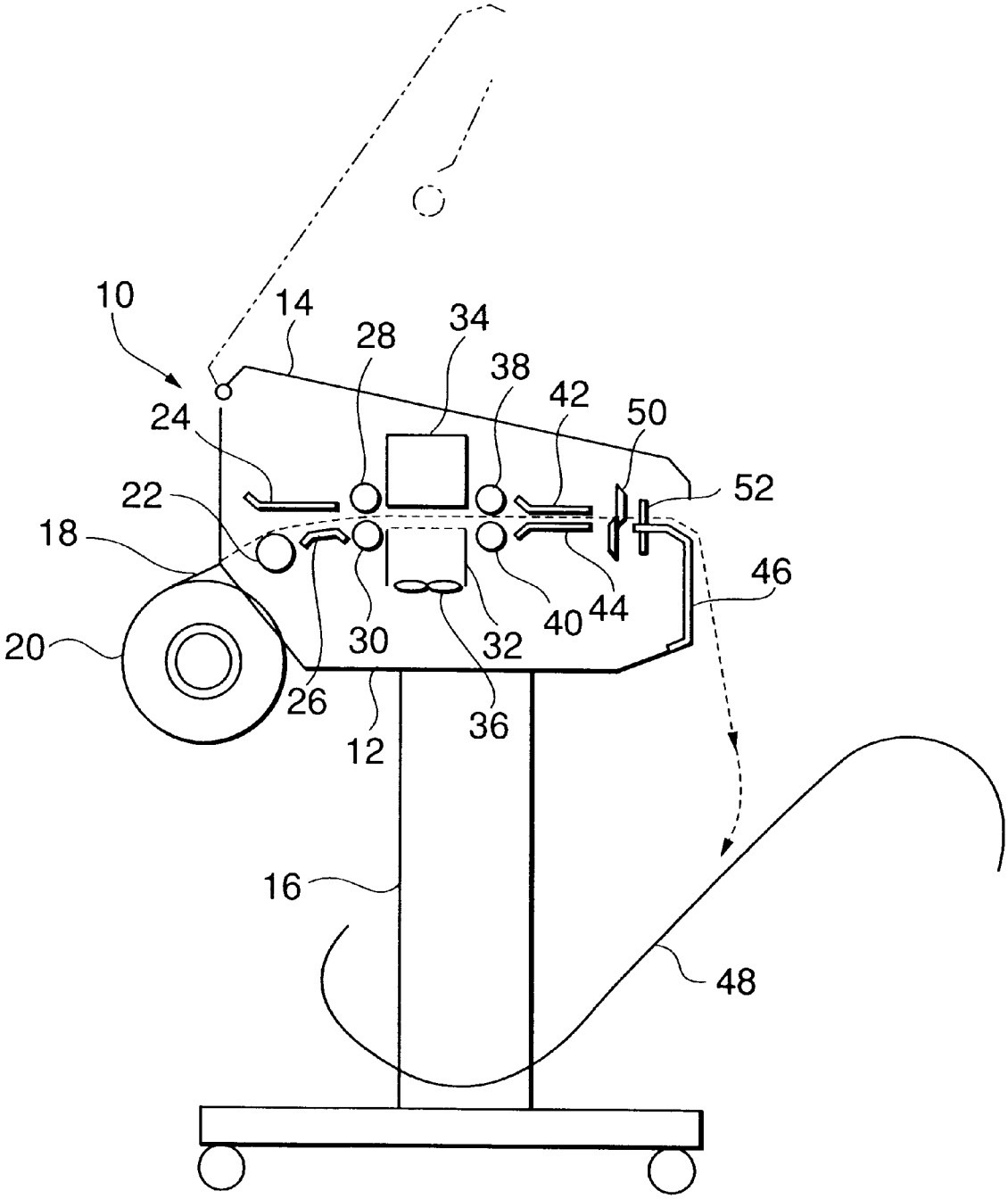
FIG. 1 is a side view diagrammatically showing a printer employing an ink tank system according to an embodiment of the present invention.

In FIG. 1, a reference numeral 10 denotes a printer unit which is housed in a longitudinal case 12, and a top surface of the case 12 forms a lid 14 which is able to be opened upward. The case 12 is supported by a pair of opposite legs 16. A roll 20 with a printing sheet 18 wound therearound is held horizontally in width direction of the case 12 at the back downside of the case 12. The printing sheet 18 is guided from the roll 20 into the case 12, and printed in the case 12. The printing sheet 18 is used as a poster or the like, its width is broad, and the maximum width of about 54 inches is used.

The printing sheet 18 is guided by a guide roller 22 to a gap between a pair of upper and lower guide plates 24 and 26, further held between a pair of upper and lower feed rollers 28 and 30, and fed toward a front face of the case 12. While the printing sheet 18 is rested on a platen 32, printing is performed by a printer head 34 which moves along the top surface of the printing sheet 18 in the width direction (transverse direction). Additionally, the platen 32 has multiple small holes on its top surface, and the small holes are sucked to a negative pressure by an evacuate fan 36. Therefore, the printing sheet 18 is sucked onto a surface of the platen 32 by a suction pressure acting on the small holes, and fixedly adheres to the surface of the platen 32.

The printer head 34 is of a piezo-ink jet system in which a piezoelectric element pressurizes a small amount of ink to eject ink droplets to the printing sheet 18, and four color ejection nozzles of cyan, magenta, yellow and black are arranged in width direction of the printing sheet 18. The printer head 34 moves along the top surface of the printing sheet 18 held by the platen 32 in the width direction to perform printing.

The printing sheet 18 is passed under the printer head 34, fed between a pair of upper and lower sheet rollers 38, 40, to be discharged from the printer section, further passed between a pair of upper and lower guide plates 42, 44, and guided downward by a guide plate 46. The printing sheet 18 is placed into a large-sized basket-like tray 48 which is attached between the pair of opposite legs 16.

Moreover, a cutter 50 is disposed close to one edge of the printing sheet 18 between the guide plates 42, 44 and the guide plate 46. The cutter 50 cuts the printed printing sheet while moving from the left end to the right in the width direction of the sheet 18. Additionally, since the printing sheet 18 has a broad width (about 54 inches at maximum), its cut portion hangs downward while the cutter 50 is moving, and its uncut portion is wrinkled. A clear cutting is thus impossible. To solve the problem, in the embodiment, an end of the cut printing sheet is pressed and fixed by a pressing lever 52 from above on the cutting start side of the cutter 50. When the cutter 50 reaches the terminal end of the printing sheet 18, the pressing lever 52 raises to release the printing sheet 18. Therefore, since the right and left ends of the cut printing sheet 18 drop substantially simultaneously, printed sheets are orderly collected on the tray 48 without being wrinkled.

Figure 2:
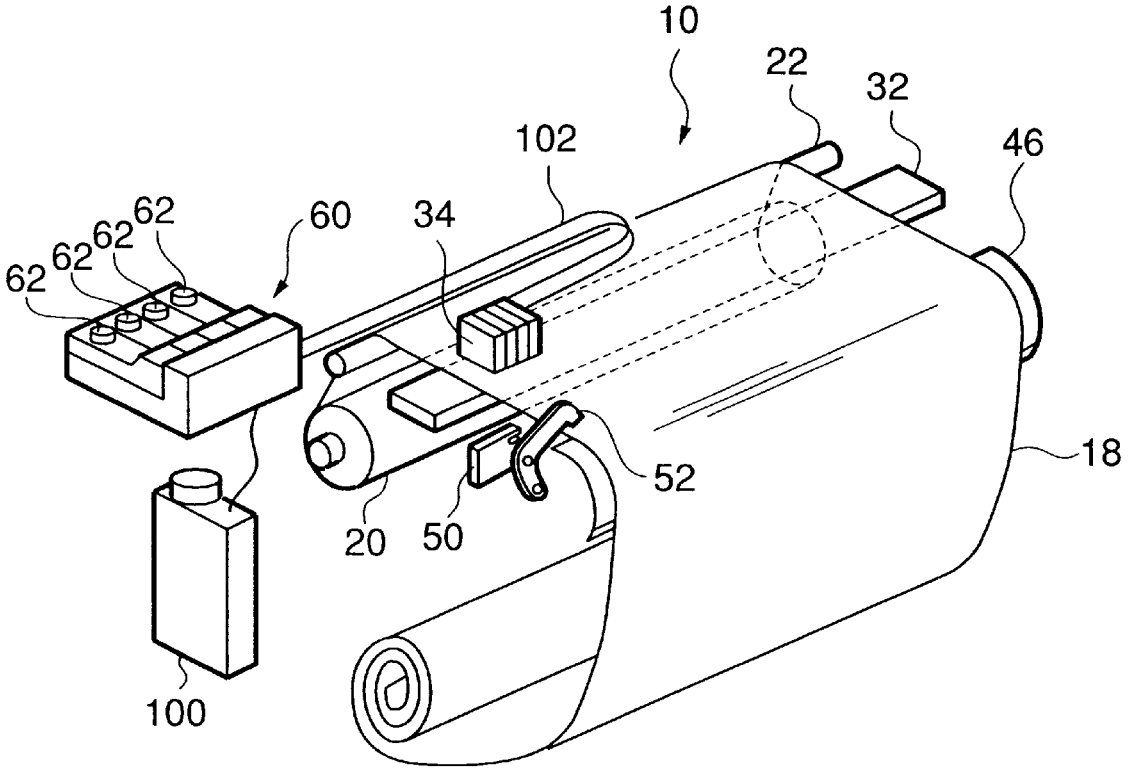
FIG. 2 is a perspective view illustrating an inner arrangement of main parts of the printer and an ink supply line of the embodiment.
Figure 3:
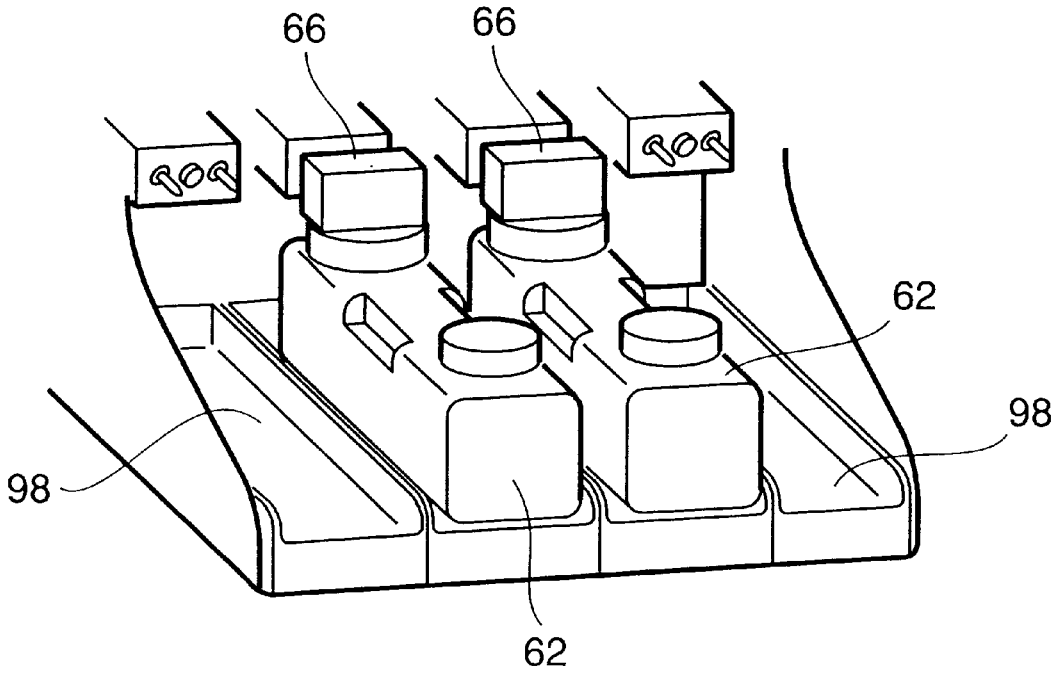
FIG. 3 is a perspective view showing the ink tank mounted on an ink tank mounting section as seen from a backside of the printer.

An ink tank unit 60 will next be described. As shown in FIG. 2, the ink tank unit 60 is disposed on the rear face of the case 12 and, as shown in FIG. 3, includes four ink tanks 62 which can be detachably mounted from rear (only two are shown in FIG. 3). The four ink tanks 62 contain inks of four colors corresponding to the four color ejecting nozzles of the print head 34, i.e., inks of cyan, magenta, yellow and black, respectively. Since connector sections for connecting the ink tanks 62 and the printer unit 10 have the same structure, one of the connector sections will be described.

Figure 4:
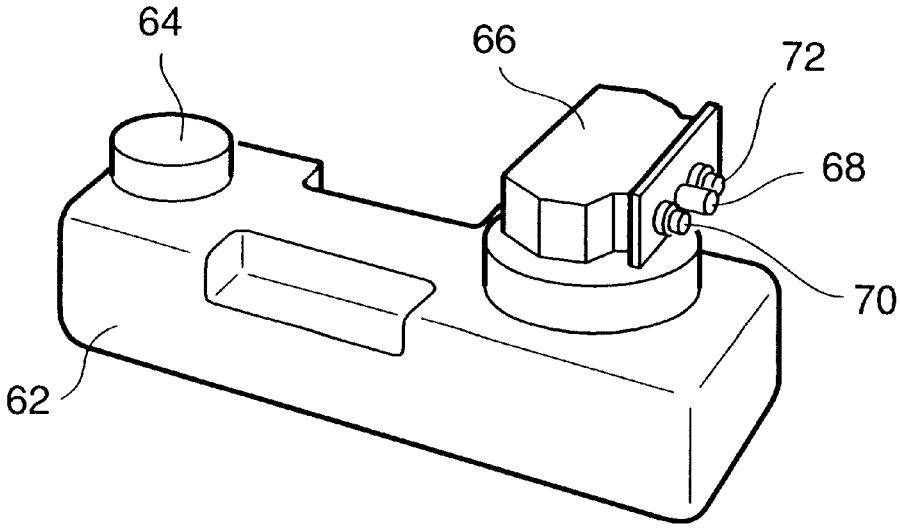
FIG. 4 is a perspective view showing the ink tank of the embodiment.

The ink tank 62 has a substantial square pole configuration extended back and forth, and includes an ink injection cap 64 and a connector head 66 on its top surface (refer to FIG. 4). The connector head 66 has a seal release port 68 protruded horizontally in a longitudinal direction of the ink tank 62, and an air inlet or port 70 and an ink outlet or port 72 which are arranged parallel on opposite sides of the seal release port 68. The central seal release port 68 is protruded ahead of the air inlet port 70 and ink outlet port 72 (FIGS. 4 and 5).

Figure 5:
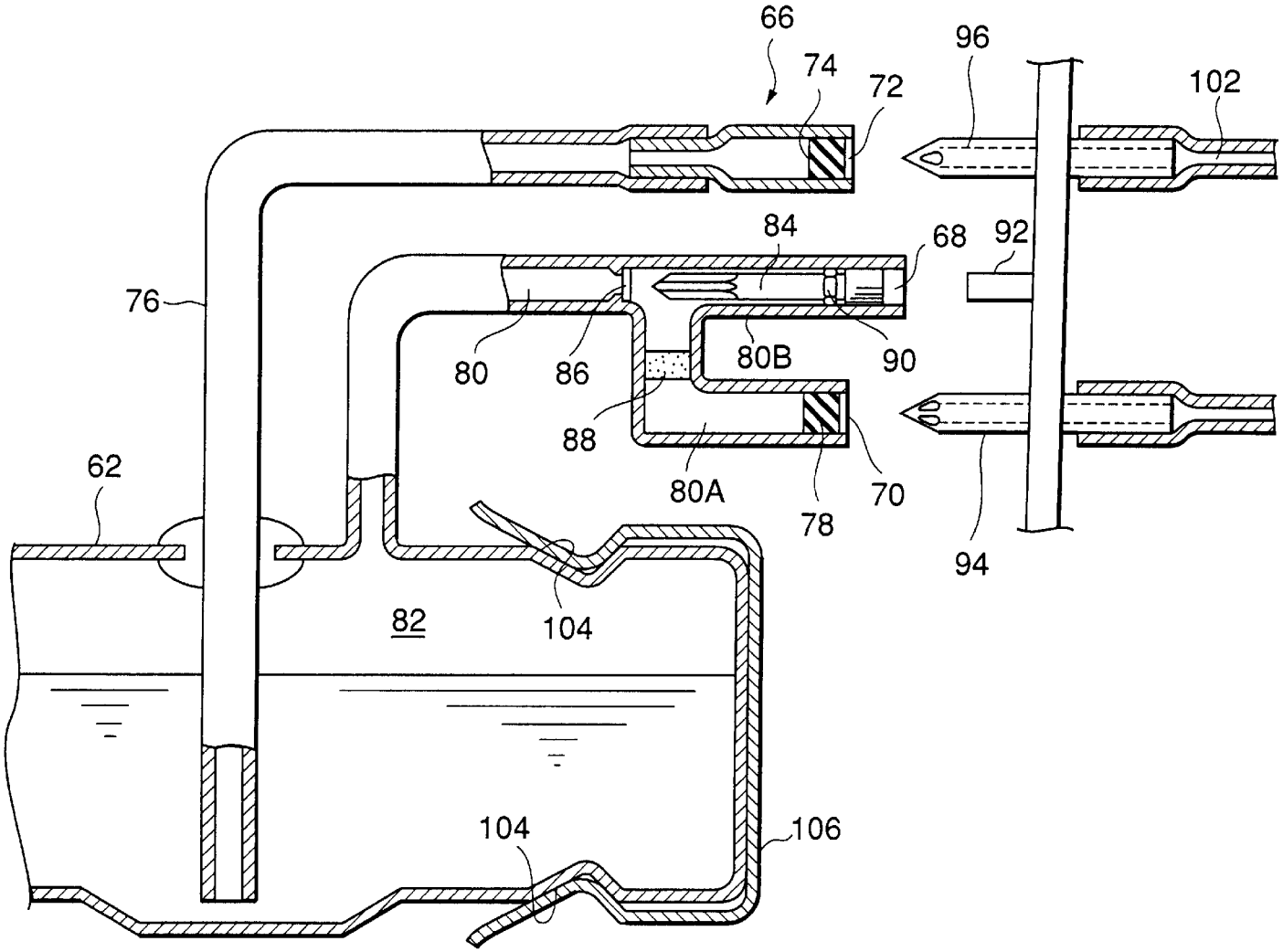
FIG. 5 is a sectional view showing a structure of a connector head of the ink tank of the embodiment.

As shown in FIG. 5, a main seal 74 is provided within the ink outlet 72, and a pipe 76 as an ink supply channel is further connected to the ink outlet 72. The pipe 76 is extended to and communicated with the vicinity of a bottom inside the ink tank 62. Additionally, the pipe 76 is passed through a wall of the ink tank 62, but it is natural that the passed portion is hermetically sealed between an outer peripheral face of the pipe 76 and a hole inner face of the ink tank 62.

A main seal 78 is provided within the air inlet 70, the air inlet 70 is connected to an air supply channel 80 via the main seal 78, and the air supply channel 80 is connected to and communicated with an upper air chamber 82 inside the tank 62. The main seals 74 and 78 are formed, for example, of thick soft rubber plates, so that needle-like ink receiving pin 96 and pressurized air supply pin 94 can easily penetrate the respective seals with maintaining the hermetical sealing condition between the inside of the tank 62 and open air of the outside of the tank 62.

The air supply channel 80 is branched to a main air supply channel 80A and an auxiliary channel 80B, as shown in FIG. 5. The main channel 80A communicates with the air inlet 70 through an air filter 88. The auxiliary channel extends to and communicates with the seal release port 68. At the downstream side from the position branching the main and auxiliary channels 80A, 80B, a auxiliary seal 86 formed of a thin film is interposed in the air supply channel 80.

A piston-like pin 84 is slidably inserted in the seal release port 68 and a tip end of the pin 84 is opposed to the auxiliary seal 86. When broken by the pin 84, the auxiliary seal 86 loses its sealing properties, so that opposite sides of the auxiliary seal 86 of the air supply channel 80 are interconnected. The air filter 88 is attached inside a main channel 80A between the auxiliary seal 86 and the main seal 78 of the air inlet 70. Moreover, an O ring 90 is engaged to the pin 84 to prevent the air supply channel 80 from being connected to the atmosphere via the seal release port 68.

On the other hand, on the side of the printer body 10, a seal releasing protrusion 92, and a first hollow needle, i.e., the pressurized air supply pin 94 and a second hollow needle, i.e., the ink receiving pin 96 positioned on opposite sides of the protrusion 92 are extended opposite to the connector head 66 of each ink tank 62. These pin 92, 94, 96 can advance into and engage with the seal release port 68, the air inlet 70 and the ink supply outlet 72, respectively, when the ink tank 62 is mounted onto a mounting section 98 (FIG. 3). Additionally, in FIG. 2, numeral 100 denotes a drain tank for collecting waste ink which have been ejected for cleaning of the each jetting nozzle of the print head 34.

With such construction, before the ink tank 62 is mounted onto the mounting section 98, the air inlet 70 and the ink supply outlet 72 are sealed by the main seals 78 and 74, respectively, and the seal release port 68 is also sealed by the O ring 90. Therefore, the ink tank 62 is completely shielded from the atmosphere. Additionally, since the auxiliary seal 86 is interposed between the air filter 88 disposed in the main channel 80A and the inside of the ink tank 62, there is no possibility that the ink in the ink tank 62 adheres to the air filter 88.

When the ink tank 62 is mounted onto the mounting section 98, the air supply pin 94 and the ink receiving pin 96 break and advance into the main seals 78 and 74, while the protrusion 92 pushes the slidable pin 84 inside the seal release port 68. As a result, when the pin 84 breaks the auxiliary seal 86, the air inlet 70 is connected to the air chamber 82 inside the ink tank 62. Pressurized air of a constant pressure (about 1.3 kg/cm$^2$) is supplied to the air supply pin 94 from an air pump (not shown) disposed on the side of the printer unit 10 to pressurize the air chamber 82 of the ink tank 62. Therefore, the ink is force-fed to the ink receiving pin 96 via the pipe 76. The ink receiving pin 96 is connected to the printer head 34 by a pipe 102, so that ink is supplied to each ink jetting nozzle.

Recesses 104 shown in FIG. 5 are formed in the left and right side faces of the ink tank 62. A stopper 106 formed of a metal leaf spring disposed on the mounting section 98 of the printer unit 10 is engaged with the recesses 104, so that the ink tank 62 is fixed in a predetermined position.

In the embodiment the ink outlet 72 and the air inlet 70 on the opposite sides of the seal release port 68 are positioned behind the seal release port 68, the ink supply outlet or port 72 and the air inlet or port 70 can be prevented from being damaged or dust can be prevented from adhering to the ports while the ink tank 62 is transported.

As aforementioned, in the present invention, when the ink tank is mounted, the seal releasing pin protruded on the printer unit opens the auxiliary seal for sealing between the air filter in the air supply channel and the air chamber in the ink tank. Therefore, when the ink tank is not mounted yet, ink can be prevented from adhering to the air filter by sealing between the inside of the ink tank and the air filter with the auxiliary seal. Moreover, after the ink tank is mounted, the pressurized air is passed through the air filter and fed into the ink tank, no dust, therefore, enters the ink tank together with the pressurized air, and there is no possibility that the clogging of the printer head causes printing failure.

Since the auxiliary seal is automatically opened when the ink tank is mounted, operation is simplified. Different from a system in which the auxiliary seal is opened by a manually operated lever or the like, incorrect operation of the lever does not occur. The auxiliary seal used herein is preferably constituted in such a manner that the film disposed in the air supply channel is broken by the slidable pin pushed by the seal releasing protrusion on the side of the printer unit.

Moreover, when the seal release port is disposed parallel between and adjacent to the air inlet or port and the ink supply outlet or port on the side of the ink tank, and the seal release port is protruded ahead of the other air and ink ports, no obstacles easily abut on the air and ink ports while the ink tank is transported. Therefore, the air and ink ports can be prevented from becoming dirty or damaged.

What is claimed is:

1. An ink tank system for supplying ink to a print head of an ink jet printer from a replaceable ink tank by pressurizing inside of the ink tank with pressurized air, comprising:

an air supply channel disposed with the ink tank for feeding the pressurized air supplied from a printer unit into the ink tank, the air supply channel having an auxiliary seal for closing the channel and, at an upstream side of the auxiliary seal, being branched to a main air supply channel and an auxiliary channel, an air filter being disposed in the main air supply channel;

an ink supply channel disposed with the ink tank;

an air inlet disposed on an upstream terminal end of said main air supply channel and having a first main seal for hermetically sealing the air inlet;

an ink outlet disposed on a downstream terminal end of said ink supply channel of the ink tank and having a second main seal for hermetically sealing the ink outlet;

a seal release port disposed on a terminal end of said auxiliary channel;

a first hollow needle disposed on the side of the printer unit and being engageable with said air inlet to advance into the air inlet to hermetically penetrate the first main seal, said first hollow needle supplying the pressurized air into the ink tank via said air supply channel;

a second hollow needle disposed on the side of the printer unit and being engageable with said ink outlet to advance into the ink outlet to hermetically penetrate the second main seal, said second hollow needle receiving the ink stored the ink tank to feed the ink to the print head; and a seal releasing protrusion disposed on the side of printer unit and advancing into said seal release port to break sealing of said auxiliary seal, said first hollow needle, said second hollow needle and said seal releasing protrusion being extended parallel with one another;

wherein, when the ink tank is mounted on the printer unit, said first and second hollow needles being hermetically passed through said first and second main seals, respectively, and said seal releasing protrusion being advanced into said seal release port to open said auxiliary seal, whereby the pressurized air supplied via said first hollow needle is passed through said air filter in said main air supply channel and the opened auxiliary seal in said air supply channel and fed into the ink tank, and the ink in the pressurized ink tank is force-fed toward the print head via said second hollow needle.

2. The ink tank system according to claim 1, further comprising:

a slidable pin closing said seal release port, slidably inserted in said auxiliary channel while keeping hermetic sealing, pushed and moved by said seal releasing protrusion to break the sealing of said auxiliary seal by tip end of the slidable pin and open said air supply channel at the time the tank is mounted.

3. The ink tank system according to claim 2, wherein said auxiliary seal has a film to be broken by the tip end of said slidable pin.

4. The ink tank system according to claim 1, wherein said air inlet and said ink outlet are arranged parallel on opposite sides of and adjacent to said seal release port, and said seal release port is protruded ahead of said air inlet and said ink outlet in a tank mounting direction.

5. A replaceable ink tank for use in an ink jet printer, in which ink is supplied from the ink tank to a print head of the printer by pressurizing inside of the ink tank with pressurized air, comprising:

an air supply channel for feeding the pressurized air supplied from a printer unit into the ink tank, provided in the channel with an auxiliary seal for closing the channel, an upstream side of the auxiliary seal being branched to a main air supply channel and an auxiliary channel, and having an air filter in the main air supply channel;

an ink supply channel for feeding the ink of the ink tank toward the printer unit;

an air inlet disposed on an upstream terminal end of said main air supply channel, provided with a first main seal for hermetically sealing said air inlet, said air inlet being approached and the first main seal being hermetically penetrated by a first hollow needle provided on the side of the printer unit, and receiving the pressurized air from the first hollow needle to supply the pressurized air into the ink tank via said air supply channel;

an ink outlet disposed on a downstream terminal end of said ink supply channel of the ink tank, provided with a second main seal for hermetically sealing said ink outlet, said ink outlet being approached and the second main seal being hermetically penetrated by a second hollow needle disposed on the side of the printer unit, and feeding the ink to the print head through the second hollow needle; and a seal release port disposed on a terminal end of the auxiliary channel, said seal release port being approached and said auxiliary seal being broken by a seal releasing protrusion disposed on the side of printer unit, said first hollow needle, said second hollow needle and said seal releasing protrusion being extended parallel with one another;

wherein, when the ink tank is mounted on the printer unit, said first and second hollow needles being hermetically passed through said first and second main seals, respectively, and said seal releasing protrusion being advanced into said seal release port to open the auxiliary seal, whereby the pressurized air supplied via said first hollow needle is passed through said air filter in said main air supply channel and the opened auxiliary seal in said air supply channel and fed into the ink tank, and the ink of the pressurized ink tank is force-fed toward the print head via said second hollow needle.

6. The replaceable ink tank according to claim 5, further comprising:

a slidable pin closing said seal release port, slidably inserted in said auxiliary channel while keeping hermetic sealing, pushed and moved by said seal releasing protrusion to break the sealing of said auxiliary seal by a tip end of said slidable pin and open said air supply channel at the time the tank is mounted.

7. The replaceable ink tank according to claim 5, wherein said auxiliary seal has a film to be broken by the tip end of said slidable pin.

8. The replaceable ink tank according to claim 5, wherein said air inlet and said ink outlet are arranged parallel on opposite sides of and adjacent to said seal release port, and said seal release port is protruded ahead of said air inlet and said ink outlet in a tank mounting direction.

* * * * *